US008572844B2

(12) United States Patent
Piggush

(10) Patent No.: US 8,572,844 B2
(45) Date of Patent: Nov. 5, 2013

(54) AIRFOIL WITH LEADING EDGE COOLING PASSAGE

(75) Inventor: Justin D. Piggush, Hartford, CT (US)

(73) Assignee: United Technologies Corporation, Hartford, CT (US)

( * ) Notice: Subject to any disclaimer, the term of this patent is extended or adjusted under 35 U.S.C. 154(b) by 1151 days.

(21) Appl. No.: 12/201,550

(22) Filed: Aug. 29, 2008

(65) Prior Publication Data

US 2010/0054953 A1 Mar. 4, 2010

(51) Int. Cl.
*B21D 53/78* (2006.01)

(52) U.S. Cl.
USPC ..... 29/889.7; 416/96 R

(58) Field of Classification Search
USPC ..... 416/96 R, 97 R, 97 A; 415/115, 116; 29/889.7, 889.72, 889.721, 889.722, 29/327.5
See application file for complete search history.

(56) References Cited

U.S. PATENT DOCUMENTS

| | | | | |
|---|---|---|---|---|
| 3,978,731 | A | 9/1976 | Reeder et al. | |
| 4,684,322 | A * | 8/1987 | Clifford et al. | 416/95 |
| 5,735,335 | A | 4/1998 | Gilmore et al. | |
| 5,820,337 | A | 10/1998 | Jackson et al. | |
| 6,000,906 | A | 12/1999 | Draskovich | |
| 6,099,251 | A * | 8/2000 | LaFleur | 416/97 R |
| 6,139,258 | A | 10/2000 | Lang, III et al. | |
| 6,164,912 | A | 12/2000 | Tabbita et al. | |
| 6,234,755 | B1 | 5/2001 | Bunker et al. | |
| 6,247,896 | B1 | 6/2001 | Auxier et al. | |
| 6,280,140 | B1 | 8/2001 | Soechting et al. | |
| 6,607,355 | B2 | 8/2003 | Cunha et al. | |
| 6,705,831 | B2 | 3/2004 | Draper | |
| 6,890,154 | B2 | 5/2005 | Cunha | |
| 6,896,487 | B2 | 5/2005 | Cunha et al. | |
| 6,913,064 | B2 | 7/2005 | Beals et al. | |
| 6,929,054 | B2 | 8/2005 | Beals et al. | |
| 6,932,145 | B2 | 8/2005 | Frasier et al. | |
| 6,932,571 | B2 | 8/2005 | Cunha et al. | |
| 6,955,522 | B2 * | 10/2005 | Cunha et al. | 415/115 |
| 6,994,521 | B2 | 2/2006 | Liang | |
| 7,014,424 | B2 | 3/2006 | Cunha et al. | |
| 7,097,424 | B2 | 8/2006 | Cunha et al. | |
| 7,097,425 | B2 | 8/2006 | Cunha et al. | |
| 7,108,045 | B2 | 9/2006 | Wiedemer et al. | |

(Continued)

FOREIGN PATENT DOCUMENTS

| | | |
|---|---|---|
| EP | 0 924 382 | 12/1998 |
| EP | 1467064 | 10/2004 |
| EP | 1013877 | 4/2006 |

OTHER PUBLICATIONS

EP Search Report dated Apr. 17, 2013 for EP Application No. 09250973.6-1610/2159375.

*Primary Examiner* — Matthew W Such
*Assistant Examiner* — Ali Naraghi
(74) *Attorney, Agent, or Firm* — Carlson, Gaskey & Olds, P.C.

(57) ABSTRACT

A turbine engine airfoil includes an airfoil structure having an exterior surface that provides a leading edge. A first cooling passage includes radially spaced legs extending laterally from one side of the leading edge toward another side of the leading edge and interconnecting to form a loop with one another. A trench extends radially in the exterior surface along the leading edge. The trench intersects one of the first and second legs to provide at least one first cooling hole in the trench.

10 Claims, 2 Drawing Sheets

(56) References Cited

U.S. PATENT DOCUMENTS

| | | | | |
|---|---|---|---|---|
| 7,131,818 | B2 | 11/2006 | Cunha et al. | |
| 7,137,776 | B2 | 11/2006 | Draper et al. | |
| 7,172,012 | B1 | 2/2007 | Memmen | |
| 7,174,945 | B2 | 2/2007 | Beals et al. | |
| 7,185,695 | B1 | 3/2007 | Santeler | |
| 7,216,689 | B2 | 5/2007 | Verner et al. | |
| 7,217,094 | B2 | 5/2007 | Cunha et al. | |
| 7,217,095 | B2 | 5/2007 | Pietraszkiewicz et al. | |
| 7,220,103 | B2 | 5/2007 | Cunha et al. | |
| 7,255,536 | B2 | 8/2007 | Cunha et al. | |
| 7,258,156 | B2 | 8/2007 | Santeler | |
| 7,270,170 | B2 | 9/2007 | Beals et al. | |
| 7,302,990 | B2 | 12/2007 | Bunker et al. | |
| 7,303,375 | B2 * | 12/2007 | Cunha et al. | 416/90 R |
| 7,306,024 | B2 | 12/2007 | Beals et al. | |
| 7,306,026 | B2 | 12/2007 | Memmen | |
| 7,311,497 | B2 | 12/2007 | Sharma et al. | |
| 7,311,498 | B2 | 12/2007 | Cunha et al. | |
| 7,322,795 | B2 | 1/2008 | Luczak et al. | |
| 7,343,960 | B1 | 3/2008 | Frasier et al. | |
| 7,364,405 | B2 | 4/2008 | Cunha et al. | |
| 2005/0156361 | A1 | 7/2005 | Holowczak et al. | |
| 2005/0265838 | A1 | 12/2005 | Liang | |
| 2006/0107668 | A1 | 5/2006 | Cunha et al. | |
| 2006/0239819 | A1 | 10/2006 | Albert et al. | |
| 2007/0044936 | A1 * | 3/2007 | Memmen | 164/45 |
| 2007/0048122 | A1 | 3/2007 | Van Suetendael, IV et al. | |
| 2007/0048128 | A1 | 3/2007 | Cunha et al. | |
| 2007/0048134 | A1 | 3/2007 | Cunha et al. | |
| 2007/0104576 | A1 | 5/2007 | Cunha et al. | |
| 2007/0147997 | A1 | 6/2007 | Cunha et al. | |
| 2007/0172355 | A1 | 7/2007 | Cunha et al. | |
| 2007/0177976 | A1 | 8/2007 | Cunha et al. | |
| 2007/0224048 | A1 | 9/2007 | Abdel-Messeh et al. | |
| 2007/0227706 | A1 | 10/2007 | Lutjen et al. | |
| 2007/0248462 | A1 | 10/2007 | Lutjen et al. | |
| 2007/0286735 | A1 | 12/2007 | Cunha et al. | |
| 2008/0008599 | A1 | 1/2008 | Cunha et al. | |
| 2008/0019839 | A1 | 1/2008 | Cunha et al. | |
| 2008/0019840 | A1 | 1/2008 | Cunha | |
| 2008/0019841 | A1 | 1/2008 | Cunha | |
| 2008/0056909 | A1 | 3/2008 | Cunha et al. | |

* cited by examiner

AIRFOIL WITH LEADING EDGE COOLING PASSAGE

BACKGROUND

This disclosure relates to a cooling passage for an airfoil.

Turbine blades are utilized in gas turbine engines. As known, a turbine blade typically includes a platform having a root on one side and an airfoil extending from the platform opposite the root. The root is secured to a turbine rotor. Cooling circuits are formed within the airfoil to circulate cooling fluid, such as air. Typically, multiple relatively large cooling channels extend radially from the root toward a tip of the airfoil. Air flows through the channels and cools the airfoil, which is relatively hot during operation of the gas turbine engine.

Some advanced cooling designs use one or more radial cooling passages that extend from the root toward the tip near a leading edge of the airfoil. Typically, the cooling passages are arranged between the cooling channels and an exterior surface of the airfoil. The cooling passages provide extremely high convective cooling.

Cooling the leading edge of the airfoil can be difficult due to the high external heat loads and effective mixing at the leading edge due to fluid stagnation. Prior art leading edge cooling arrangements typically include two cooling approaches. First, internal impingement cooling is used, which produces high internal heat transfer rates. Second, showerhead film cooling is used to create a film on the external surface of the airfoil. Relatively large amounts of cooling flow are required, which tends to exit the airfoil at relatively cool temperatures. The heat that the cooling flow absorbs is relatively small since the cooling flow travels along short paths within the airfoil, resulting in cooling inefficiencies.

What is needed is a leading edge cooling arrangement that provides desired cooling of the airfoil.

SUMMARY

A turbine engine airfoil includes an airfoil structure having an exterior surface that provides a leading edge. In one example, a cooling channel extends radially within the airfoil structure, and a first cooling passage is in fluid communication with the cooling channel. The first cooling passage includes radially spaced legs extending laterally from one side of the leading edge toward another side of the leading edge and interconnecting to form a loop with one another. A trench extends radially in the exterior surface along the leading edge. The trench intersects one of the first and second legs to provide at least one first cooling hole in the trench.

These and other features of the disclosure can be best understood from the following specification and drawings, the following of which is a brief description.

DETAILED DESCRIPTION

Figure 1:
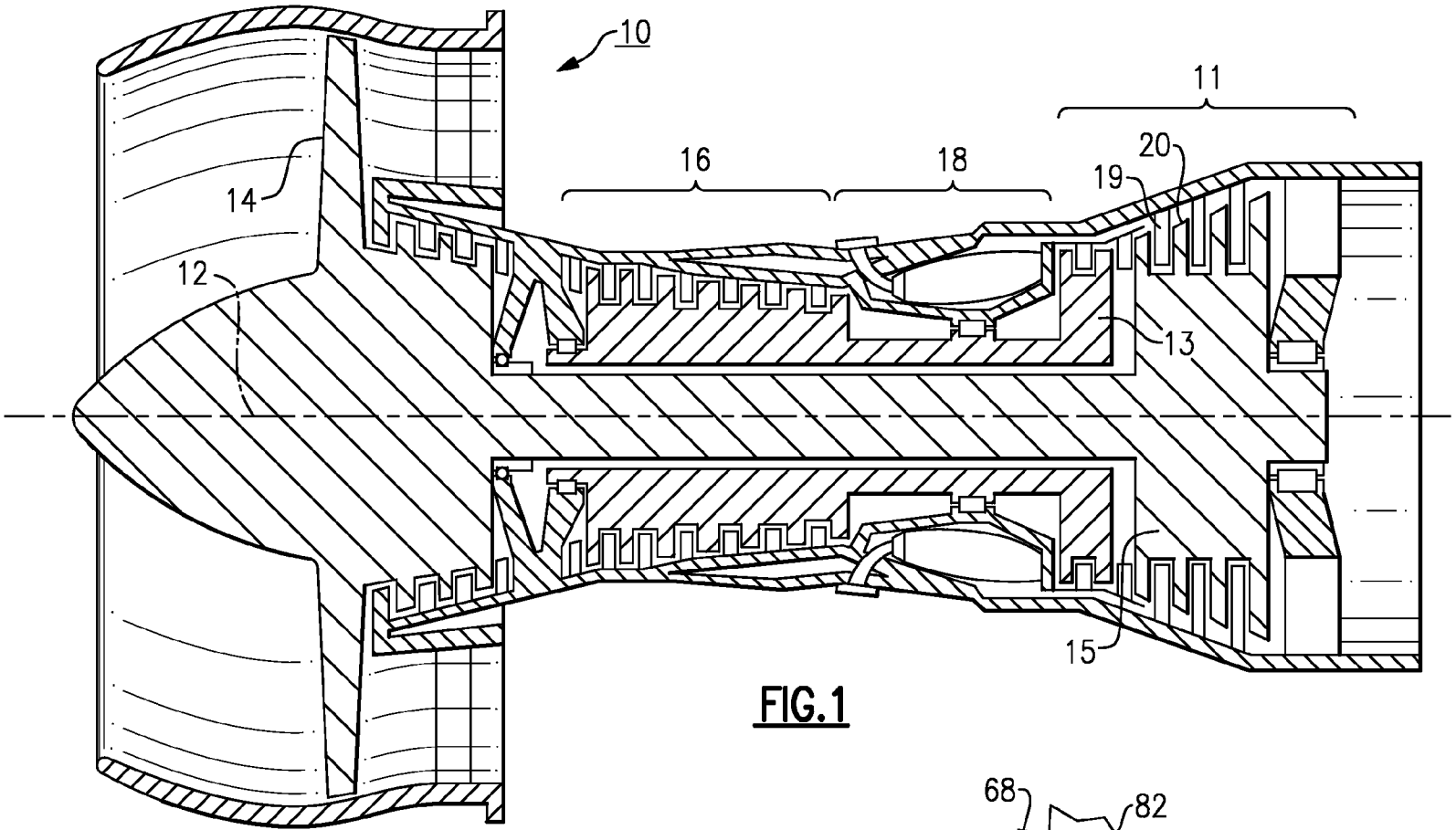
FIG. 1 is a schematic view of a gas turbine engine incorporating the disclosed airfoil.

FIG. 1 schematically illustrates a gas turbine engine 10 that includes a fan 14, a compressor section 16, a combustion section 18 and a turbine section 11, which are disposed about a central axis 12. As known in the art, air compressed in the compressor section 16 is mixed with fuel that is burned in combustion section 18 and expanded in the turbine section 11. The turbine section 11 includes, for example, rotors 13 and 15 that, in response to expansion of the burned fuel, rotate, which drives the compressor section 16 and fan 14.

The turbine section 11 includes alternating rows of blades 20 and static airfoils or vanes 19. It should be understood that FIG. 1 is for illustrative purposes only and is in no way intended as a limitation on this disclosure or its application.

Figure 2:
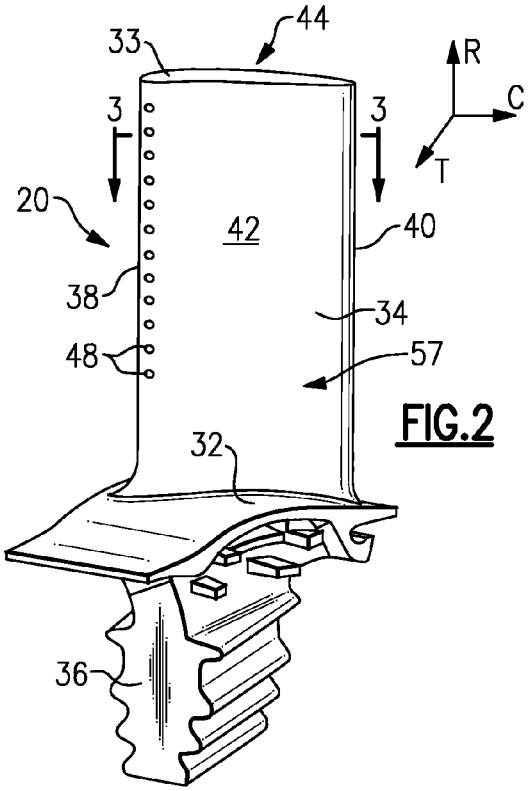
FIG. 2 is a perspective view of the airfoil having the disclosed cooling passage.

An example blade 20 is shown in FIG. 2. The blade 20 includes a platform 32 supported by a root 36, which is secured to a rotor. An airfoil 34 extends radially outwardly from the platform 32 opposite the root 36. While the airfoil 34 is disclosed as being part of a turbine blade 20, it should be understood that the disclosed airfoil can also be used as a vane.

The airfoil 34 includes an exterior surface 57 extending in a chord-wise direction C from a leading edge 38 to a trailing edge 40. The airfoil 34 extends between pressure and suction sides 42, 44 in a airfoil thickness direction T, which is generally perpendicular to the chord-wise direction C. The airfoil 34 extends from the platform 32 in a radial direction R to an end portion or tip 33. Cooling holes 48 are typically provided on the leading edge 38 and various other locations on the airfoil 34 (not shown).

Figure 3:
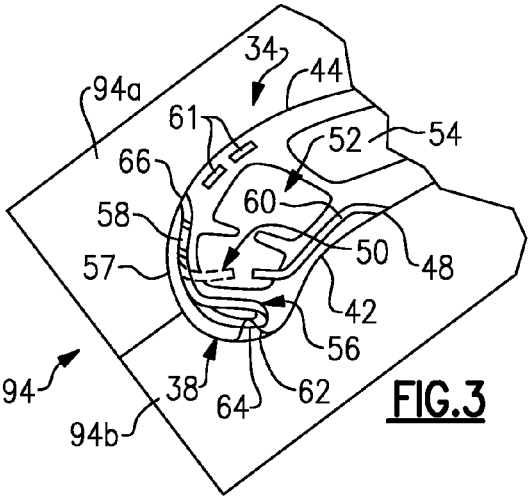
FIG. 3 is a cross-sectional view of a portion of the airfoil shown in FIG. 2 and taken along 3-3.

Referring to FIG. 3, multiple, relatively large radial cooling channels 50, 52, 54 are provided internally within the airfoil 34 to deliver airflow for cooling the airfoil. The cooling channels 50, 52, 54 typically provide cooling air from the root 36 of the blade 20.

Current advanced cooling designs incorporate supplemental cooling passages arranged between the exterior surface 57 and one or more of the cooling channels 50, 52, 54. With continuing reference to FIG. 3, the airfoil 34 includes a first cooling passage 56 arranged near the leading edge 38. The first cooling passage 56 is in fluid communication with the cooling channel 50, in the example shown. A second cooling passage 58 is also in fluid communication with the first cooling passage 56 and the cooling channel 50. In the example illustrated in FIG. 3, the first and second cooling passages 56, 58 are fluidly connected to and extend from the suction side 44 of the cooling channel 50. The first and second cooling passages 56, 58 can be provided on the pressure side 42, if desired. A third cooling passage 60 is in fluid communication with the cooling channel 50 and arranged on the pressure side 42 to provide the cooling holes 48. The third cooling passage 60 can be provided on the suction side 44, if desired. Other radially extending cooling passages 61 can also be provided.

Figure 6:
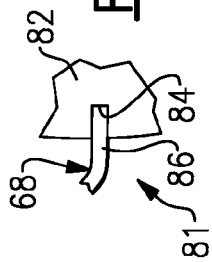
FIG. 6 is a cross-sectional view of a portion of a core assembly used in forming the cooling passage and a cooling channel shown in FIG. 3.

FIG. 3 schematically illustrates an airfoil molding process in which a mold 94 having mold halves 94A, 94B define an exterior 57 of the airfoil 34. In one example, ceramic cores (schematically shown at 82 in FIG. 6) are arranged within the mold 94 to provide the cooling channels 50, 52, 54. One or more core structures (68, 168 in FIGS. 5 and 7), such as refractory metal cores, are arranged within the mold 94 and connected to the ceramic cores. The refractory metal cores provide the first and second cooling passages 56, 58 in the example disclosed. In one example the core structure 68 is stamped from a flat sheet of refractory metal material. The core structure 68 is then shaped to a desired contour. The ceramic core and/or refractory metal cores are removed from the airfoil 34 after the casting process by chemical or other means. Referring to FIG. 6, a core assembly 81 can be provided in which a portion 86 of the core structure 68 is received in a recess 84 of a ceramic core 82. In this manner, the resultant first cooling passage 56 provided by the core structure 68 is in fluid communication with one of a corresponding cooling channel 50, 52, 54 subsequent to the airfoil casting process.

Figure 4A:
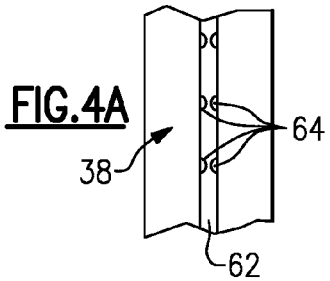
FIG. 4A is front elevation view of a portion of a leading edge of the airfoil shown in FIG. 2.
Figure 4B:
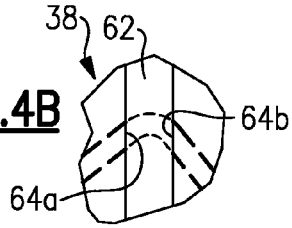
FIG. 4B is an enlarged front elevational view of FIG. 4A.

Referring to FIGS. 3-4B, the first cooling passage 56 provides a loop 76 that extends from the suction side 44 toward the leading edge 38. A radially extending trench 62 is provided on the leading edge 38, for example, at the stagnation line, to provide cooling of the leading edge 38. The trench 62 intersects the loop 76 to provide one or more cooling holes 64 in the trench 62, as shown in FIG. 4A. The trench 62 can be machined, cast or chemically formed, for example. Depending upon the position of the trench 62 relative to the loop 76, multiple cooling holes 64A, 64B (FIG. 4B) can be provided by the loop 76.

Figure 5:
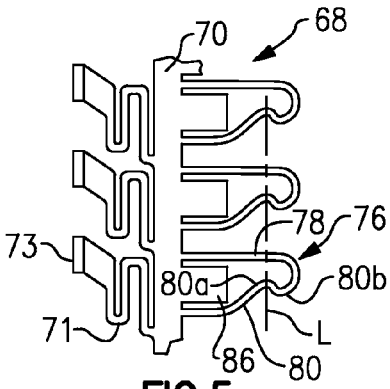
FIG. 5 is a top elevation view of a core structure used in forming a cooling passage, as shown in FIG. 3.

Referring to FIG. 5, an example core structure 68 is shown, which provides the first and second cooling passages 56, 58, shown in FIG. 3. In the example, the loop 76 that provides the first cooling passage 56 is provided by radially spaced first and second legs 78, 80 that are interconnected to one another. In one example, a generally S-shaped bend is provided in the second leg 80. The loop 76 is shaped to generally mirror the contour of the exterior surface 57. The first and second legs 78, 80 extend laterally and are offset in a generally chord-wise direction from one another along line L such that the second leg 80 is closer to the exterior surface than the first leg 78, best seen in FIG. 3. Said another way, the first leg 78 is canted inwardly relative to the second leg 80. In this manner, the trench 62 will intersect the second leg 80 at the S-shaped bend in the example without intersecting the first leg 78. The S-shaped bend results in cooling holes 64A, 64B offset from one another such that they are not co-linear, best shown in FIG. 4B. Coolant from the cooling hole 64, 64A impinges on opposite walls of the trench 62.

A radially extending connecting portion 70 interconnects multiple radially spaced loops 76 to one another. Laterally extending portions 86, which are arranged radially between the first and second legs 78, 80, are interconnected to a second core structure 82 to provide a core assembly 81, as shown in FIG. 6. In one example, the portion 86 is received in a corresponding recess 84 in the second core structure 82. The second cooling passage 58 is provided by a convoluted leg 71 that terminates in an end 73 to provide the second cooling hole 66 in the exterior 57 (FIG. 3).

Figure 7:
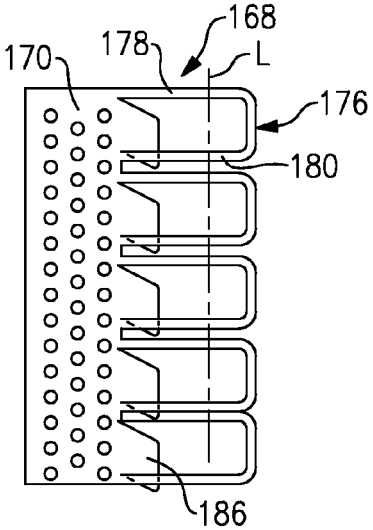
FIG. 7 is a perspective view of another example core structure.

Another example core structure 168 is illustrated in FIG. 7. The core structure 168 includes loops 176 provided by first and second legs 178, 180. The legs 178, 180 are offset relative to one another along a line L similar to the manner described above relative FIG. 5. Portions 186 extend from a connecting portion 170, which includes apertures to provide cooling pins in the airfoil structure.

Although example embodiments have been disclosed, a worker of ordinary skill in this art would recognize that certain modifications would come within the scope of the claims. For that reason, the following claims should be studied to determine their true scope and content.

What is claimed is:

1. A turbine engine airfoil comprising:

an airfoil structure including an exterior surface providing leading edge, a first cooling passage including radially spaced legs extending laterally from one side of the leading edge toward another side of the leading edge and interconnecting to form a loop with one another, a trench extending radially in the exterior surface along the leading edge, the trench intersecting one of the first and second legs of multiple loops to provide at least one first cooling hole in the trench; and a connecting portion extends radially, the first and second legs extending from the connecting portion in one direction, and a portion extends laterally from the connecting portion to a radially extending cooling channel providing fluid communication between the cooling channel and the connecting portion, the portion arranged radially between the first and second legs.

2. A turbine engine airfoil comprising:

an airfoil structure including an exterior surface providing a leading edge, a first cooling passage including radially spaced legs extending laterally from one side of the leading edge toward another side of the leading edge and interconnecting to form a loop with one another, a trench extending radially in the exterior surface along the leading edge, the trench intersecting one of the first and second legs of multiple loops to provide at least one first cooling hole in the trench; and the trench intersects only one of the first and second legs.

3. The turbine engine airfoil according to claim 2, wherein one of the first and second legs is canted inwardly from the exterior surface relative to the other of the first and second legs.

4. A turbine engine airfoil comprising:

an airfoil structure including an exterior surface providing a leading edge, a first cooling passage including radially spaced legs extending laterally from one side of the leading edge toward another side of the leading edge and interconnecting to form a loop with one another, a trench extending radially in the exterior surface along the leading edge. the trench intersecting one of the first and second legs of multiple loops to provide at least one first cooling hole in the trench; and the exterior surface at the leading edge has a contour and the loop includes a shape that is generally the same as the contour.

5. A turbine engine airfoil comprising:

an airfoil structure including an exterior surface providing a leading edge, a first cooling passage including radially spaced legs extending laterally from one side of the leading edge toward another side of the leading edge and interconnecting to form a loop with one another, a trench extending radially in the exterior surface along the leading edge, the trench intersecting one of the first and second legs of multiple loops to provide at least one first cooling hole in the trench, the one of the first and second legs provides a pair of first cooling holes opposite one another in the trench; and the one of the first and second legs includes an S-shaped bend, the trench intersecting the S-shaped bend and orienting the pair of first cooling holes in a non-collinear relationship to one another.

6. The turbine engine airfoil according to claim 5, wherein the other of the first and second legs is spaced inwardly from the exterior surface.

7. A core for manufacturing an airfoil comprising:

a core structure having multiple generally U-shaped loops spaced from one another along a first direction, the loops each including first and second legs forming the U-shape, the first leg canted relative to the second leg such that one of the first leg is offset relative to the second leg in a second direction different than the first direction; and a longitudinally extending connecting portion, each of the first and second legs of the loops interconnected to the connecting portion providing discrete loops that are each joined to the connecting portion.

8. A core according to claim 7, wherein the connecting portion extends radially and the first and second legs extend laterally therefrom, the loops spaced radially from one another.

9. A core according to claim 8, wherein portions extend laterally from the connecting portion and are arranged radially between the first and second legs, the portions oriented transverse relative to the connecting portion.

10. The core according to claim 7, wherein the second leg includes an S-shaped bend.

* * * * *